United States Patent [19]

Brunelle

[11] 4,351,718

[45] Sep. 28, 1982

[54] METHOD FOR REMOVING POLYHALOGENATED HYDROCARBONS FROM NONPOLAR ORGANIC SOLVENT SOLUTIONS

[75] Inventor: Daniel J. Brunelle, Scotia, N.Y.

[73] Assignee: General Electric Company, Schenectady, N.Y.

[21] Appl. No.: 269,121

[22] Filed: Jun. 1, 1981

[51] Int. Cl.[3] ..... C10G 29/00; C10G 29/06; C10G 29/20

[52] U.S. Cl. ..... 208/262; 585/864

[58] Field of Search ..... 208/262; 570/204; 585/864, 868

[56] References Cited

U.S. PATENT DOCUMENTS 2,212,105 8/1940 Yabroff ..... 585/864

2,481,300 9/1949 Engel ..... 208/262

FOREIGN PATENT DOCUMENTS 564683 10/1958 Canada ..... 208/262

OTHER PUBLICATIONS

The Reaction of PCB's with Sodium, Oxygen, and Polyethylene Glycols, Pytlewski et al, pp. 72–76, Franklyn Research Center, Phila., PA 19103.

*Primary Examiner*—Delbert E. Gantz

*Assistant Examiner*—Helane E. Maull

*Attorney, Agent, or Firm*—William A. Teoli; James C. Davis, Jr.

[57] ABSTRACT

A method is provided for reducing the level of polychlorinated aromatic hydrocarbons, "PCB's", while dissolved in an organic solvent, for example, transformer oil. Removal of the polychlorinated aromatic hydrocarbon, can be accomplished by treating the contaminated solution with a mixture of polyethyleneglycol and an alkali metal hydroxide.

5 Claims, No Drawings

METHOD FOR REMOVING POLYHALOGENATED HYDROCARBONS FROM NONPOLAR ORGANIC SOLVENT SOLUTIONS

CROSS REFERENCE TO RELATED APPLICATIONS

References is made to copending application John M. Brown, Jr. et al, Ser. No. 212,387, for "Method for Removing Polychlorinated Biphenyls from Transformer Oil", filed Dec. 3, 1980 and assigned to the same assignee as the present invention.

BACKGROUND OF THE INVENTION

Polychlorinated biphenyls, or "PCB's" were long used as dielectric fluids in electrical equipment because these materials have excellent heat stability, are nonflammable in nature, have low volatility and a good viscosity characteristic at operation temperatures. Because of their environmental persistence, however, continued manufacture, import, or use in the United States was banned under the Toxic Substances Control Act of 1976, and the U.S. Environmental Protection Agency was directed to promulgate rules and regulations for their removal from the economy.

As of July 1, 1979, EPA regulations defined As "PCB-contaminated" any material containing more than 50 ppm of a mono-, di-, or polychlorinated biphenyl. The regulations permit disposal of PCB-contaminated materials by either incineration in an approved manner or in an approved landfill, but such procedures have rarely proven acceptable to community neighbors. Since considerable fractions of the transformer oils, e.g., refined asphaltic-base mineral oil, or heat exchange oils, e.g., hydrogenated terphenyls, now in service are PCB-contaminated, the problem of disposing of PCB-contaminated hydrocarbon oils in an effective manner presents a serious challenge. As used hereinafter, the term "transformer oil" signifies a mineral insulating oil of petroleum origin for use as an insulating and cooling media in electrical apparatus, for example, transformers, capacitors, underground cables, etc.

Various techniques for meeting this challenge have been proposed. One method is shown by D. K. Parker et al, Plant engineering, Aug. 21, 1980, Pages 133–134. The method of Parker et al is based on the formation of a solution of an organo-sodium reagent, such as sodium naphthalenide, in a carrier solvent, for example, tetrahydrofuran, which is then added to the contaminated oil. The Parker et al process requires a multistep procedure involving first the formation of organo-sodium reagent, next the incorporation of such organo-sodium compound into the PCB-contaminated oil followed by at least 2 more hours for the reaction to be complete, followed by a water quench and distillation and purification steps to recycle the tetrahydrofuran. Another procedure, somewhat similar to the Parker et al process, is described by Smith et al, University of Waterloo, based on the graduate thesis of James G. Smith and G. L. Bubbar, "The Chemical Destruction of Polychlorinated Biphenyls by Sodium Naphthalenide". Again, a lengthy, multistep procedure is necessary before effective destruction of the PCB is achieved. A further procedure is shown by Hiraoka et al, Japan Kokai No. 74 822,570, Chem. Abstracts 8988831K, Vol. 82, 1975, which describes the destruction of polychlorinated biphenyls utilizing a sodium dispersion in Kerosene, but requires a 6 hour heating period at 120° C.

Recently, Lewis L. Pytlewski et al, demonstrated that PCB's, as well as representative halogenated pesticides were found to be rapidly and completely decomposed by the use of molten sodium metal dispersed in polyethyleneglycol. The Pytlewski et al technique is shown in the reaction of PCB's with sodium, oxygen, and polyethyleneglycols, Chemistry and Biosciences Lab, Franklyn Research Center, Philadelphia, Pa. 19103. However, the use of metallic sodium metal requires the special handling and trace amounts of water must be eliminated to minimize dangerous side reactions.

The present invention is based on the discovery that alkali metal hydroxides, for example, potassium hydroxide, can be used with polyethyleneglycols in an effective manner which has been found to completely eliminate or substantially reduce polyhalogenated aromatic hydrocarbon in substantially inert organic solvent.

STATEMENT OF THE INVENTION

There is provided by the present invention a method of treating a PCB contaminated solution of a substantially inert organic solvent having a concentration of polyhalogenated aromatic hydrocarbon at up to 1% by weight to reduce the polyhalogenated aromatic hydrocarbon concentration to less than 50 ppm, which comprises, agitating a mixture at a temperature of 65° C. to 200° C. comprising such substantially inert organic solvent solution of polyhalogenated aromatic hydrocarbon, polyalkyleneglycol and alkali metal hydroxide for a time which is at least sufficient to effect the minimum aforedescribed reduction in concentration of the polyhalogenated aromatic hydrocarbon in the agitated mixture which comprises by weight, (A) up to 1% of polyhalogenated aromatic hydrocabon,
(B) about 0.1 to 10% of polyalkyleneglycol,
(C) about 0.1 to 10% of alkali metal hydroxide, and
(D) about 80 to 99.8% of substantially inert organic solvent, where the sum of (A)+(B)+(C)+(D) is equal to 100%.

Polyalkyleneglycols which can be used in the practice of the present invention are, for example, polymers having a molecular weight in the range of from about 200 to 5000 and include, for example, tetraethylene glycol, pentaethylene glycol, hexaethylene glycol, etc. Polyethylene glycol which are included can have molecular weight, for example, 200, 300, 400, 600, 800, 1000, 1500, 3400, etc.

Alkali metal hydroxides which can be used in the practice of the present invention are, for example, sodium hydroxide, potassium hydroxide, cesium hydroxide, etc.

In the practice of the present invention, a mixture of polyalkyleneglycol and alkali metal hydroxide is utilized in combination with PCB contaminated non-polar organic solvent. The resulting mixture is thereafter agitated in an oxidizing or non-oxidizing atmosphere until the level of the PCB contaminant is reduced to less than 50 ppm of polyhalogenated aromatic hydrocarbon.

Temperatures in the range of between 90° C. to 120° C. is preferred, whereas a temperature in the range of between 65° C. to 200° C. can be used.

It has been found that a proportion of 1 to 50 equivalents of alkali metal of the alkali metal hydroxide, per OH of the polyalkyleneglycol can be used to make the MOH/PEG reagent, where M represents an alkali metal as previously defined with respect to the alkali metal hydroxide usage, while PEG represents polyalkyleneglycol and preferably polyethyleneglycol as previously defined.

It has been found that effective results can be achieved if at least one equivalent of alkali metal per OH of the glycol will be effective for removing one equivalent of halogen atom from the PCB. Higher amounts are preferably used to facilitate PCB removal.

The MOH/PEG reagent can be preformed, or the aforementioned ingredients can be added separately within the aforementioned limits to the PCB contaminated, non-polar organic solvent. Experience has shown that agitation of the resulting mixture, such as stirring or shaking, is necessary to achieve effective results when the MOH/PEG reagent has ben introduced into the contaminated non-polar organic solvent.

In order to effectively monitor the reduction or removal of PCB or polyhalogenated aromatic hydrocarbon contamination, such as polychlorinated biphenyl contamination in the non-polar or substantially inert organic solvent, a vapor phase chromatograph, for example, Model No. 3700, of the Varian Instrument Company, can be used in accordance with the following procedure:

An internal standard, for example, n-docosane can be added to the initial reaction mixture. The standard is then integrated relative to the PCB envelop to determine ppm concentration upon VPC analysis.

In order that those skilled in the art will be better able to practice the invention, the following examples are given by way of illustration and not by way of limitation. All parts are by weight.

EXAMPLE 1

There were added to a reaction vessel, 2 parts of polyethyleneglycol having an average molecular weight of 300 PEG 300), of the Aldrich Chemical Company, of Milwaukee, Wis., 0.5 part of ground 85% KOH, a predetermined amount of Arochlor 1260 and 0.0125 part of N-docosane dissolved in 1.0 part of toluene and 15 part of a 25% toluene solution in heptane. The resulting mixture contained 9400 ppm of polychlorinated biphenyl. The two-phase mixture was stirred magnetically and heated to 100° C. After 1.5 hour of stirring at 100° C., the resulting mixture contained 49 ppm of polychlorinated biphenyl. After 3 hours the polychlorinated biphenyl could not be detected.

The same reaction was repeated, except that in place of PEG 300 there was used 2 parts of PEG 600, 0.18 part of Arochlor 1260 and 0.50 part of KOH. The resulting mixture initially contained 9400 ppm of polychlorinated biphenyl. After 1.5 hour of stirring at 100° C. the resulting mixture contained 20 ppm of polychlorinated biphenyl. After 3 hours, no polychlorinated biphenyl was detected.

The above results show that the method of the present invention is effective for reducing PCB contamination in non-polar organic solvents.

EXAMPLE 2

There was added 0.5 part of PEG 300 and 0.1 part of powdered KOH to 10 parts of transformer oil contaminated with 650 ppm of PCB's. The resulting two-phase mixture was heated to 100° C. while it was rapidly stirred. Aliquots were removed periodically from the mixture and filtered through celite. VPC analysis using an electron capture detector showed that the mixture contained 16 parts of PCB after 1 hour stirring at 100° C. and polychlorinated biphenyls could not be detected in the mixture after 2 hours stirring at 100° C.

The above reaction was repeated, except that the mixture was stirred for 1 hour at 125° C. VPC analysis showed that the mixture contained only 2 ppm of PCB. In addition VPC analysis of the polyethyleneglycol phase showed that it was free of PCB.

EXAMPLE 3

A reagent was prepared in accordance with the method of Pytlewski et al, Chemistry and Biosciences Lab, Franklyn Research Center, The Reaction of PCB's with Sodium, Oxygen, and Polyethyleneglycols. A mixture of 200 parts of PEG 400 and 1.2 part of freshly cut sodium was vigorously stirred under nitrogen at 100° C. for 5 hours.

A mixture of 18 parts of the above sodium/polyethyleneglycol reagent, 0.09 part of Arochlor 1260 and 0.025 part of N-docosane dissolved in 1.0 part of hexane was stirred at 75° C. for 1.5 hours under a nitrogen atmosphere. The resulting mixture was allowed to cool and diluted with a 5:1 hexane/toluene mixture. Analysis by VPC showed that a mixture which initially contained 5000 ppm of polychlorinated biphenyl had 800 ppm of polychlorinated biphenyl remaining.

A mixture of 4 parts of the Na/PEG reagent, 30 parts of a 10% toluene heptane mixture and 0.36 part of Arochlor 1260 which was dissolved in toluene containing 0.025 part per ml of the toluene solution of N-docosane. The resulting two-phase mixture containing 9400 ppm of polychlorinated biphenyl was heated under nitrogen at 100° C. and stirred vigorously for 1.5 hour. Analysis of the toluene/heptane ayer by VPC showed 6720 ppm of polychlorinated biphenyl remaining. After 5 hours it contained 5280 ppm.

The above procedure was repeated, except that there was utilized 4 parts of PEG 400 and 1 part of KOH in accordance with the practice of the invention in place of the Na/PEG reagent. Analysis of the resulting mixture by VPC showed 49 ppm of polychlorinated biphenyl remaining after 1.5 hour, and no detectable polychlorinated biphenyl after 3 hours.

EXAMPLE 4

A series of comparisons between the use of the Na/PEG reagent of Pytlewski et al and the KOH/PEG reagent of the present invention was made in 10% toluene/heptane mixtures containing polychlorinated biphenyls under nitrogen and in the presence of air or oxygen to determine the effectiveness of these reagents to remove PCB's from non-polar organic solvents. Temperatures in the range of from 75°-100° C. were used and reaction time of ½ hour to 5 hours were employed. The amount of polychlorinated biphenyl utilized in the mixtures was 9400 ppm and the percent reaction is a quantitative indication of PCB removal in the mixtures, are shown below in Table I, where atmosphere indicates $O_2$ when air was bubbled through the mixture, "air" when the reaction vessel was lightly capped and $N_2$ when an inert nitrogen atmosphere was used.

TABLE I

| Reagent (eq) | PCB | Atmosphere | Time (hr) | Temp (°C.) | % Reaction |
|---|---|---|---|---|---|
| Na/PEG (5) | 1260 | $O_2$ | 1 | 100 | 27 |

TABLE I-continued

| Reagent (eq) | PCB | Atmosphere | Time (hr) | Temp (°C.) | % Reaction |
|---|---|---|---|---|---|
| Na/PEG (5) | 1260 | $N_2$ | 1 | 100 | 36 |
| KOH/PEG (5) | 1260 | air | 1 | 100 | 92 |
| Na/PEG (10) | 1254 | air | ½ | 100 | 20 |
| KOG/PEG (10) | 1254 | air | ½ | 100 | 55 |
| Na/PEG (10) | 1242 | air | 1 | 100 | 10 |
| KOH/PEG (10) | 1242 | air | 1 | 100 | 45 |

The above results show that the PCB removal from contaminated non-polar organic solvents can be achieved more effectively with the KOH/PEG reagent in accordance with the practice of the present invention. In addition, the reaction can proceed in an oxidizing or non-oxidizing atmosphere.

Although the above examples are directed to only a few of the very many variables which can be used in the practice of the present invention, it should be understood that the method of the present invention is directed to the use of a much broader variety of polyalkyleneglycols and alkali metal hydroxides which can be used to effect the reduction or removal from various non-polar organic solvents, a wide variety of polychlorinated biphenyls.

What I claim as new and desire to secure by Letters Patent of the United States is:

1. A method of treating a substantially inert organic solvent solution of polyhalogenated aromatic hydrocarbon present in such inert organic solvent solution at a concentration of up to 1% by weight of the mixture to reduce the polyhalogenated aromatic hydrocarbon concentration to less than 50 ppm, which comprises, agitating a mixture at a temperature of 65° C. to 200° C. comprising such substantially inert organic solvent solution of polyhalogenated aromatic hydrocarbon, polyalkyleneglycol having a molecular weight of about 200 to about 5000 and alkali metal hydroxide for a time which is at least sufficient to effect the minimum aforedescribed reduction in concentration of the polyhalogenated aromatic hydrocarbon in the agitated mixture which comprises by weight (A) up to about 1% of polyhalogenated aromatic hydrocarbon, (B) about 0.1 to 10% of polyalkyleneglycol, (C) about 0.1 to 10% of alkali metal hydroxide, and (D) about 80 to 99.8% of substantially inert organic solvent, where the sum of (A)+(B)+(C)+(D) is equal to 100%.

2. A method in accordance with claim 1, where the polyalkyleneglycol is a polyethyleneglycol having a molecular weight of about 400.

3. A method in accordance with claim 1, where the alkali metal hydroxide is potassium hydroxide.

4. A method in accordance with claim 1, where the substantially inert organic solvent is transformer oil.

5. A method in accordance with claim 1, where the polyhalogenated aromatic hydrocarbon is a polychlorinated biphenyl.

* * * * *